US005241795A

United States Patent [19]

Giroux et al.

[11] Patent Number: 5,241,795

[45] Date of Patent: Sep. 7, 1993

[54] BUILDING MATERIALS MADE FROM WASTE AND UNUSUAL PROPERTIES THEREOF

[76] Inventors: Francis A. Giroux, 13 Dixon Ct.; Andrew D. Tellier, 2 Bronk Dr., both of Queensbury, N.Y. 12804

[21] Appl. No.: 851,305

[22] Filed: Mar. 12, 1992

[51] Int. Cl.[5] ..... E04B 3/00

[52] U.S. Cl. ..... 52/DIG. 9; 106/15.05; 52/503

[58] Field of Search ..... 52/DIG. 9, 503, 505, 52/405

[56] References Cited

U.S. PATENT DOCUMENTS

| | | | |
|---|---|---|---|
| 831,732 | 9/1906 | Momsen | 52/503 |
| 3,292,331 | 12/1966 | Sams | 52/405 |
| 4,586,958 | 5/1986 | Matsuura et al. | 106/18.12 X |
| 4,812,169 | 3/1989 | Matsuura et al. | 106/15.05 |

FOREIGN PATENT DOCUMENTS

| | | | |
|---|---|---|---|
| 904600 | 7/1972 | Canada | 52/DIG. 9 |
| 2810603 | 9/1979 | Fed. Rep. of Germany | 52/405 |
| 3735638 | 5/1989 | Fed. Rep. of Germany | 52/503 |

*Primary Examiner*—Carl D. Friedman
*Assistant Examiner*—Creighton Smith

[57] ABSTRACT

The invention relates to building materials made from paper sludge, repulped waste paper, or virgin paper pulp, mixed with clay and portland cement, or animal protein adhesives, or manufactured resins or polymers. Specifically the invention relates to a building system using this material in the form of building blocks that are glued together during assembly and are intended to be used for above grade exterior and interior walls. A block design which increases the R-value and other building products made of this material are covered in this invention. The material of this invention has unusual compression strength properties such that; when an imposed load limit is reached which begins to compress the material, the material does not break apart, but rather compresses slightly and allows considerably more load to be imposed without failure of the material to hold the superimposed load.

3 Claims, 2 Drawing Sheets

BUILDING MATERIALS MADE FROM WASTE AND UNUSUAL PROPERTIES THEREOF

INTRODUCTION

The present invention relates to building components and materials made from waste and recycled materials, especially building blocks intended to be used for above grade exterior and interior walls, and the building system employing same. Also an unusual compression strength property is examined as well as a block design that increases the R-value.

BACKGROUND OF THE INVENTION

The prior art of masonry wall construction presents numerous problems that the present invention addresses. Specifically; the prior art is labor intensive with the requirement of skilled labor. The structure formed is rigid, unable to be easily nailed to or cut with common tools, is uninsulated and unfinished, usually requiring another wood frame structure to be built inside of the masonry structure.

There are newer "insulating" masonry block systems that employ both mortar bonding and dry stacked surface bonding methods. These address the insulation issue, though not fully. Some incorporate air cavities that are too wide to provide good insulating value without inserting other insulating material. These cavities are wide enough to establish a convection current inside the block which transfers the heat almost as fast as though there were no cavity. Also the issues of nailability, cutability, and skilled labor intensive assembly are not addressed.

Other "insulating" non-masonry blocks propose the use of wood fiber materials such as sawdust bound with thermosetting and thermoplastic resin. A cost analysis will reveal that this proposition is cost prohibitive. Also some of these blocks fail to provide any passage for plumbing or electrical component installation. Also no provision is made for fire resistance or fire proofing.

Prior art wood frame construction is also labor intensive and provides little fire resistance.

A nearly lost art in today's building code intensive environment is that of adobe construction, which incorporates a relatively weak and moisture sensitive mud or clay block wall stuccoed on both sides for strength and protection against water. This construction relies on the spreading of the imposed load across a large area of wall section in order to achieve the required strength. A similar system comprised of building blocks of the present invention, which are not as strong as masonry blocks, would be sufficient to meet today's building codes as long as areas of concentrated imposed loads are reinforced as proposed later.

OBJECT OF THE INVENTION

The object of the invention is to produce building materials out of waste, recycled, or virgin paper/cellulose pulp materials and by-products using various binding and reinforcing agents including but not limited to; portland cement, animal proteins, and manufactured resins and polymers.

Another object of this invention is to design a building system consisting of this material in the form of building blocks, which can easily be manufactured with existing masonry block manufacturing machinery, assembled with a foam adhesive, intended to be used for both exterior and interior walls. These blocks are light weight, easily cut and shaped with woodworking tools, nailable, insulating, fire resistant, and easily assembled. They incorporate chases for electrical and plumbing component installation as well as reinforcing members for areas of concentrated imposed loads. The blocks also incorporate a series of air cavities designed to reduce the conduction of heat without allowing convection, thereby increasing the insulating properties of the system. The blocks could also be prefinished to minimize labor expense.

Another object of the invention is to produce other building components including ceiling panels, wall panels, subflooring, door panels, door jambs, casings, baseboards, cabinets, parquet flooring, roofing, siding, etc., all made out of the same materials.

DESCRIPTION OF THE INVENTION

Paper sludge, the primary by-product of the paper manufacturing process, has been disposed of by landfilling for as long as paper has been manufactured in this country. For those factories that have not contaminated their sludge with toxic chemicals such as some bleaching agents, the present invention affords a beneficial use for the sludge. When the water content of the sludge is properly reduced and the sludge is then added to the proper amounts of clay and portland cement, then pressed in shape and cured and properly dried, the resulting material is a light weight, insulating, relatively strong product useful as proposed in this invention. If the sludge is properly dried and added to certain animal protein adhesives or manufactured resins or polymers in various concentrations, it will produce a material which can be manufactured into a number of useful products, as mentioned previously. Fire proofing is provided by adding a fire retarding agent.

Repulped waste paper of Virgin paper pulp can be used in the same manner as the sludge just mentioned to produce a similar result.

During structural testing of some of the materials of the present invention, an interesting property was discovered. In most structural materials like concrete, compression strength testing will yield a maximum imposed load beyond which the material will completely and destructively fail and collapse, further damaging all that is beneath it. Some of the materials of the present invention when being compressed beyond a certain imposed load, (let's call it the Geometric Imposed Load Limit) will begin to compress slightly but while doing so will withstand even more imposed load. The more the imposed load is increased, the more the material compresses and the more load it will then carry, up to a certain point. This maximum load beyond which the material simply compresses without increased strength, (let's call it the Maximum Imposed Load Limit) is approximately 133% of the Geometric Imposed Load Limit. The amount of compression during the overloading is gradual and measurable and by the time the Maximum imposed load limit is reached the rate of compression is increased. Usually the compression encountered between the Geometric Imposed Load Limit and the Maximum Imposed Load Limit is approximately ten percent of the height of the sample being tested. Even at this Maximum Imposed Load Limit the material doesn't catastrophically fail but simply compresses at a slow rate. The advantages of building with materials exhibiting this property is that when the Geometric Imposed Load Limit is exceeded there is plenty of warning and the structure is still safe to evacuate and repair without risk of catastrophic failure.

The building blocks of the present invention take two basic forms, one for exterior and load bearing walls, and the other for interior walls. Other special blocks which are provided for end walls, corners, door and window openings, etc. are not illustrated here.

Figure 1:
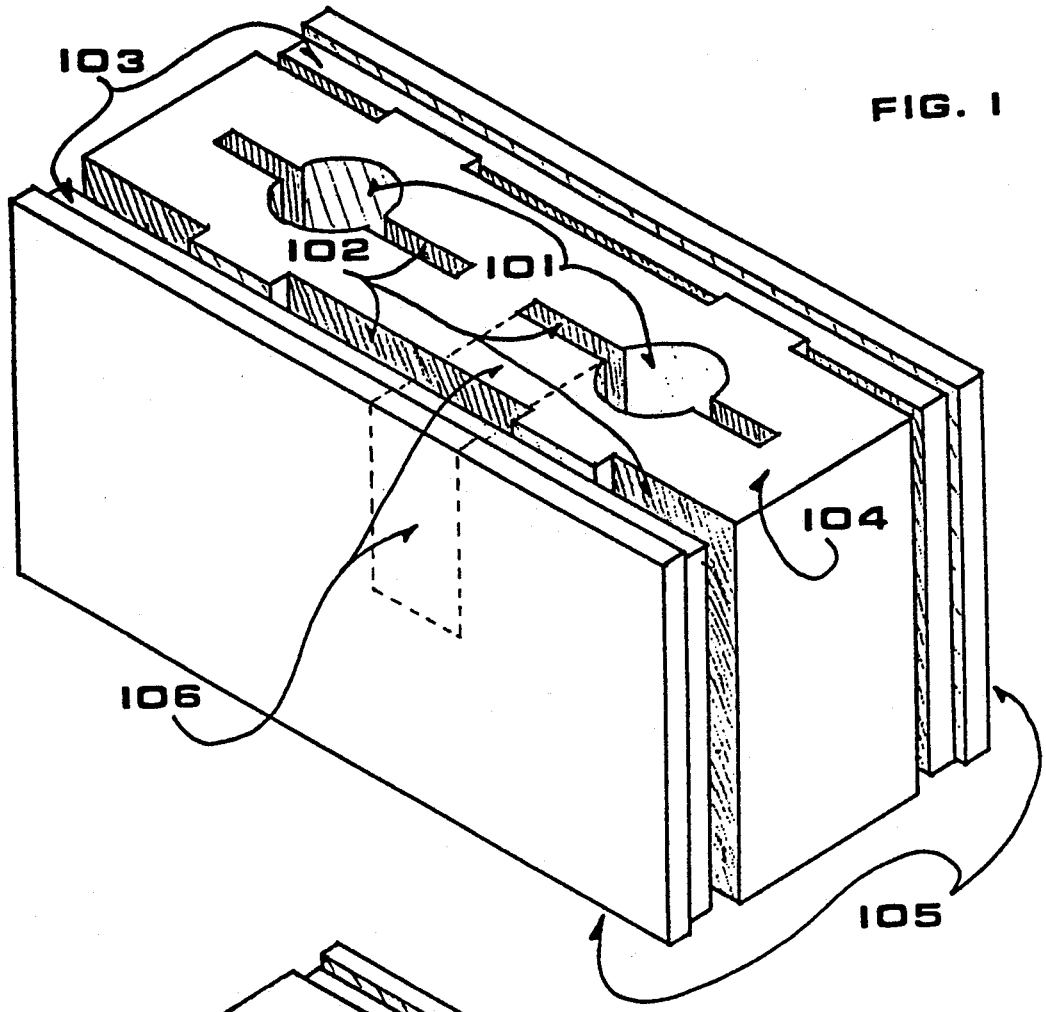
FIG. 1 is a perspective view of a block for exterior walls and load bearing partitions. Note the chases 101 for plumbing and electrical component installation, the rectangular dead air cavities 102 which enhance the insulating value of the block and allow air to flow during the curing and drying portions of the manufacturing process, and the recesses 103 which provide room for the foam adhesive. Note also that the load bearing portion of the block 104 is parallel with the edge of the face 105 enabling a tight joint between adjacent blocks. 106 shows the proposed cutout area for electrical fixture box.

The exterior blocks consist of a solid block of standard size with vertical cavities including two cylindrical cavities and numerous rectangular cavities as shown in the drawings. These cavities run the entire height of the block. The narrow dead air cavities are a maximum of ¾ inch thick which blocks the conduction through the block that would occur if the block were solid, yet because of their small size also prevent convection within the cavities. R-value evaluations were done on blocks with only two cylindrical holes as well as blocks incorporating the same cylindrical holes as well as the narrow cavities illustrated in FIG. 1. Incorporation of the cavities, in this case ½ inch thick, increased the calculated R-value from R-11 to R-25. The interior blocks are similar to the exterior blocks with the two exterior panels removed. The width of the interior blocks is 4.5 inches in order that the interior walls will be the same width as that of a standard 2×4 wall with ½ inch drywall applied on each side, allowing standard door jambs and door units to be easily installed. Recesses are incorporated near the outer surface along the top and ends of the block so that foam adhesive can be applied as the wall unit is being assembled.

Figure 2:
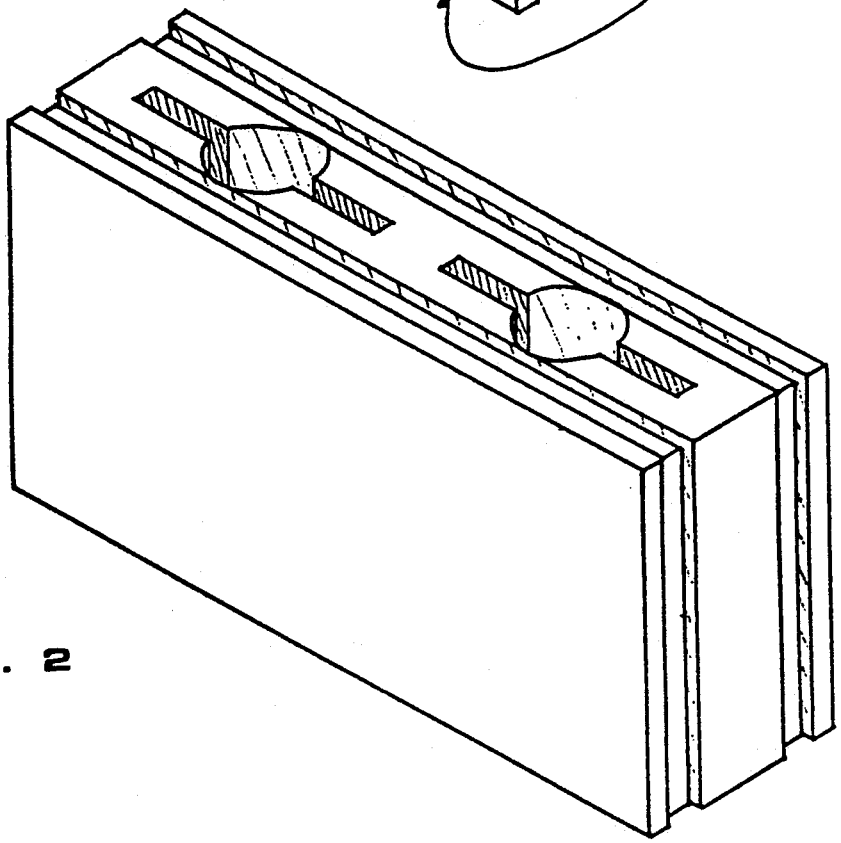
FIG. 2 is a perspective view of a block for interior walls.
Figure 3:
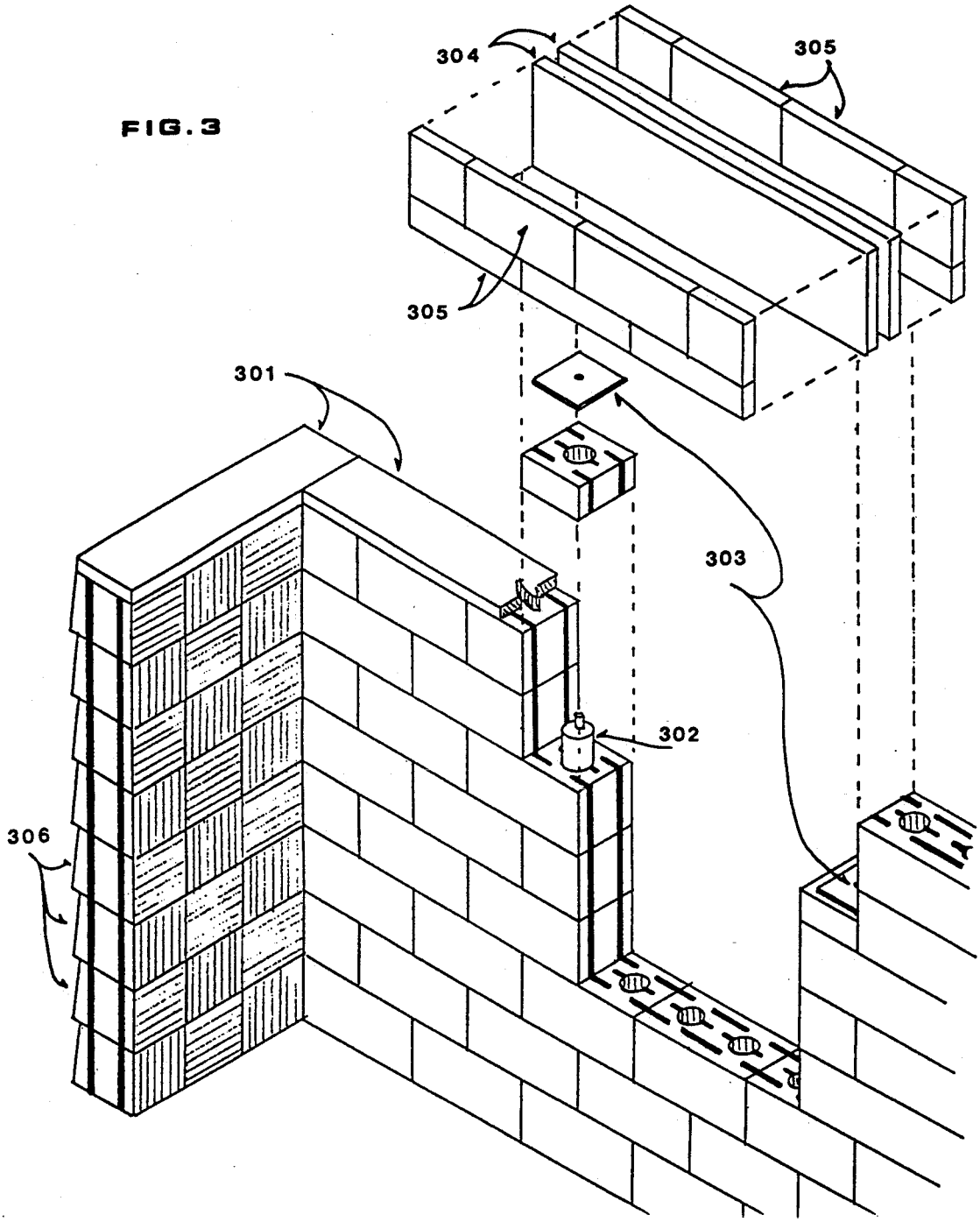
FIG. 3 is a perspective view of a section of an exterior wall showing the installation of a window opening. Notice the top plate 301 that distributes the load from joists or trusses, and the load bearing posts 302 and plates 303 that carry the concentrated imposed load from the window headers 304. Also notice the face blocks 305 which are the face portions of a whole block cut from an exterior wall block FIG. 1 and glued to the window headers. Notice also 306 shows prefinished blocks with simulated overlapped exterior siding and simulated interior parquet finish.

The building system proposed here is that of an array of these blocks laid up as illustrated in FIG. 2, glued together during assembly with a foam adhesive like urethane foam. In areas of concentrated imposed loads, like next to large windows and doors or where a carrying beam is installed, a supporting post is installed inside the blocks in one or more of the cylindrical passages. A plate is attached to the top of the posts and the headers or carrying beams are attached to the plate. Electrical and plumbing facilities are installed through the passages provided and the walls are finished by spraying on a textured finish. Exterior surfaces may be stuccoed, sprayed, or sided with any exterior siding by simply nailing directly into the blocks.

What is claimed is:

1. A building material comprising the by-product of the paper making process, mixed with cement, whereby building components may be formed that are light weight, insulating, easily cut and shaped with woodworking tools, nailable, glueable, and fire resistent.

2. A building system comprising the materials described in claim 1 in the form of building blocks, which may be assembled with adhesive, whereby the blocks may contain passage ways for installation of electrical and plumbing fixtures as well as narrow dead air cavities which increase the insulating properties of the structure as described earlier, and may be easily manufactured with existing masonry block manufacturing machinery and may be prefinished.

3. Other building materials comprising the materials described in claim 1 including ceiling panels, wall panels, door panels, door jambs, casings, baseboards, cabinets, flooring panels and tiles, roofing, siding, furniture, and other structural and nonstructural materials.

* * * * *